US010760204B2

(12) United States Patent
Solè Pizarro et al.

(10) Patent No.: US 10,760,204 B2
(45) Date of Patent: Sep. 1, 2020

(54) FLATWORK IRONER

(71) Applicant: GIRBAU, S.A., Vic Barcelona (ES)

(72) Inventors: Carles Solè Pizarro, Vic Barcelona (ES); Joaquim Riera Peidro, Vic Barcelona (ES)

(73) Assignee: GIRBAU, S.A., Vic Barcelona (ES)

( * ) Notice: Subject to any disclaimer, the term of this patent is extended or adjusted under 35 U.S.C. 154(b) by 115 days.

(21) Appl. No.: 16/306,752

(22) PCT Filed: Jun. 8, 2016

(86) PCT No.: PCT/ES2016/070429
§ 371 (c)(1),
(2) Date: Dec. 3, 2018

(87) PCT Pub. No.: WO2017/212081
PCT Pub. Date: Dec. 14, 2017

(65) Prior Publication Data
US 2019/0218705 A1 Jul. 18, 2019

(51) Int. Cl.
*D06F 69/02* (2006.01)
*D06F 67/00* (2006.01)
*D06F 67/04* (2006.01)

(52) U.S. Cl.
CPC ..... *D06F 69/02* (2013.01); *D06F 67/00* (2013.01); *D06F 67/04* (2013.01)

(58) Field of Classification Search
CPC .... D06F 69/00; D06F 69/02; D06F 71/00–40; D06F 59/00–08; D06F 61/00–10; D06F 63/00–02; D06F 65/00–10; D06F 67/00–10; D06F 67/005
See application file for complete search history.

(56) References Cited

U.S. PATENT DOCUMENTS 2,176,529 A * 10/1939 Mcgiveron ..... A43D 95/02 111/154
2,319,416 A * 5/1943 Litle, Jr. ..... D06F 65/06 38/60
2,343,543 A * 3/1944 Ferris ..... D06F 67/08 38/66
3,027,285 A * 3/1962 Eisner ..... B32B 37/185 156/359
3,286,077 A * 11/1966 Radford ..... D06F 71/34 219/251

(Continued)

FOREIGN PATENT DOCUMENTS

KR 449820 Y1 * 8/2010

*Primary Examiner* — Ismael Izaguirre
(74) *Attorney, Agent, or Firm* — Silvia Salvadori

(57) ABSTRACT

The flatwork ironer comprises a heating cylinder (1), a plurality of conveying bands (2), defining said conveying bands (2) a plurality of zones in an introduction area of articles to be ironed, and a plurality of temperature sensors (3) of said heating cylinder (1), indication means for indicating at least one zone (5) of the conveying bands where the articles to be ironed must be placed according to the temperature detected by said plurality of sensors (3), wherein said indicating means are placed in said are for introducing the articles to be ironed.
It permits to place correctly the articles to be ironed in the correct position not looking away from the introduction area.

6 Claims, 2 Drawing Sheets

(56) References Cited

U.S. PATENT DOCUMENTS

| | | | | | |
|---|---|---|---|---|---|
| 4,425,489 | A * | 1/1984 | Pav | F26B 13/183 | 100/330 |
| 5,551,175 | A * | 9/1996 | Neyman | B08B 5/02 | 15/316.1 |
| 5,787,321 | A * | 7/1998 | Nishikawa | G03G 15/2042 | 165/205 |
| 5,933,988 | A * | 8/1999 | Adler | D06F 67/02 | 38/44 |
| 6,882,804 | B2 * | 4/2005 | Eskey | G03G 15/2042 | 219/216 |

* cited by examiner

FLATWORK IRONER

This application is a U.S. national stage of PCT/ES2016/070429 filed on 8 Jun. 2016.

The present invention refers to a flatwork ironer, that detects temperature differences and identifies the zones where the articles to be ironed must be placed.

BACKGROUND OF THE INVENTION

The use of flatwork ironers for accelerating the process of ironing articles is known, e.g. for ironing as quick as possible bed or table linens, such as bed sheets or tablecloths.

The flatwork ironers comprise a heating cylinder and conveying bands where the articles to be ironed are placed. The ironing is done by the contact of the heating cylinder and the conveying bands, leaving said articles already ironed from said flatwork ironer.

One drawback of said currently known flatwork ironers is that the heating cylinder does not present a uniform temperature during its use, because its contact with the articles to be ironed, which can be humid, makes some zones more heat than others, being advisable to use determined zones of the conveying bans according to their temperature.

For solving this drawback is known to use temperature sensors placed in the flatwork ironer, detecting the temperature of the heating cylinder and determining the zone of the conveying bands on which the articles to be ironed must be placed at each time.

The indication of the zones on which the articles must be placed is done by a display. However, in practice it has been shown that the use of this display does not solve completely this problem, because the operator must look away from the zone where the articles to be ironed are inserted. For this reason, the operator does not look the display a lot of times, or if he/she looks the display, the productivity of the flatwork ironer decreases.

Therefore, the object of the present invention is to provide a flatwork ironer in which at each moment the zones of the conveying bans where the articles to be ironed must be placed at each time, but making this indication to the operator easier, so that he/she really places the articles in the suitable zones with no decrease in the productivity of the ironer.

DESCRIPTION OF THE INVENTION

With the flatwork ironer of the invention said drawbacks can be solved, presenting other advantages that will be disclosed hereinafter.

The flatwork ironer according to the present invention comprises:

- a heating cylinder;
- a plurality of conveying bands, defining said conveying bands a plurality of zones in an introduction area of the articles to be ironed; and
- a plurality of temperature sensor of said heating cylinder,
- indication means for indicating at least one zone of the conveying bands where the articles to be ironed must be placed according to the temperature detected by said plurality of sensors, and it is characterized in that said indication means are placed in said introduction area of the articles to be ironed.

Therefore, thanks to the placement of the indication means in said introduction are, the operator does not need to look away from the introduction area, permitting the placement of the articles in the correct zone not decreasing the productivity.

According to a preferred embodiment, said indication means is a light emitted from a plurality of light emitters that light at least one zone of the conveying bands. Said lighted zone of the conveying bands can be the zone where the articles to be ironed are placed or the zone where they must not be placed, according to the configuration of the ironer.

Therefore, the zones where the articles to be ironed must be placed are lighted by the light emitters according to the temperature detected by the sensors (or where they must not be placed), and the operator just places the articles to be ironed in the indicated zones not looking away from the conveying bands.

E.g. said light emitters can be light emitting diodes (LEDs) o laser light emitters.

Advantageously, said light emitters are placed adjacent to the introduction area of said conveying band to be lighted directly.

If wished, the flatwork ironer according to the present invention can also comprise a visualization display indicating at least one zone of the conveying bands and other information related with the operation of the ironer.

BRIEF DESCRIPTION OF THE DRAWINGS

For a better comprehension of that has been disclosed, some drawings are attached in which, diagrammatically and only as a non-limitative example, a practical embodiment is shown.

DESCRIPTION OF A PREFERRED EMBODIMENT

Figure 1:
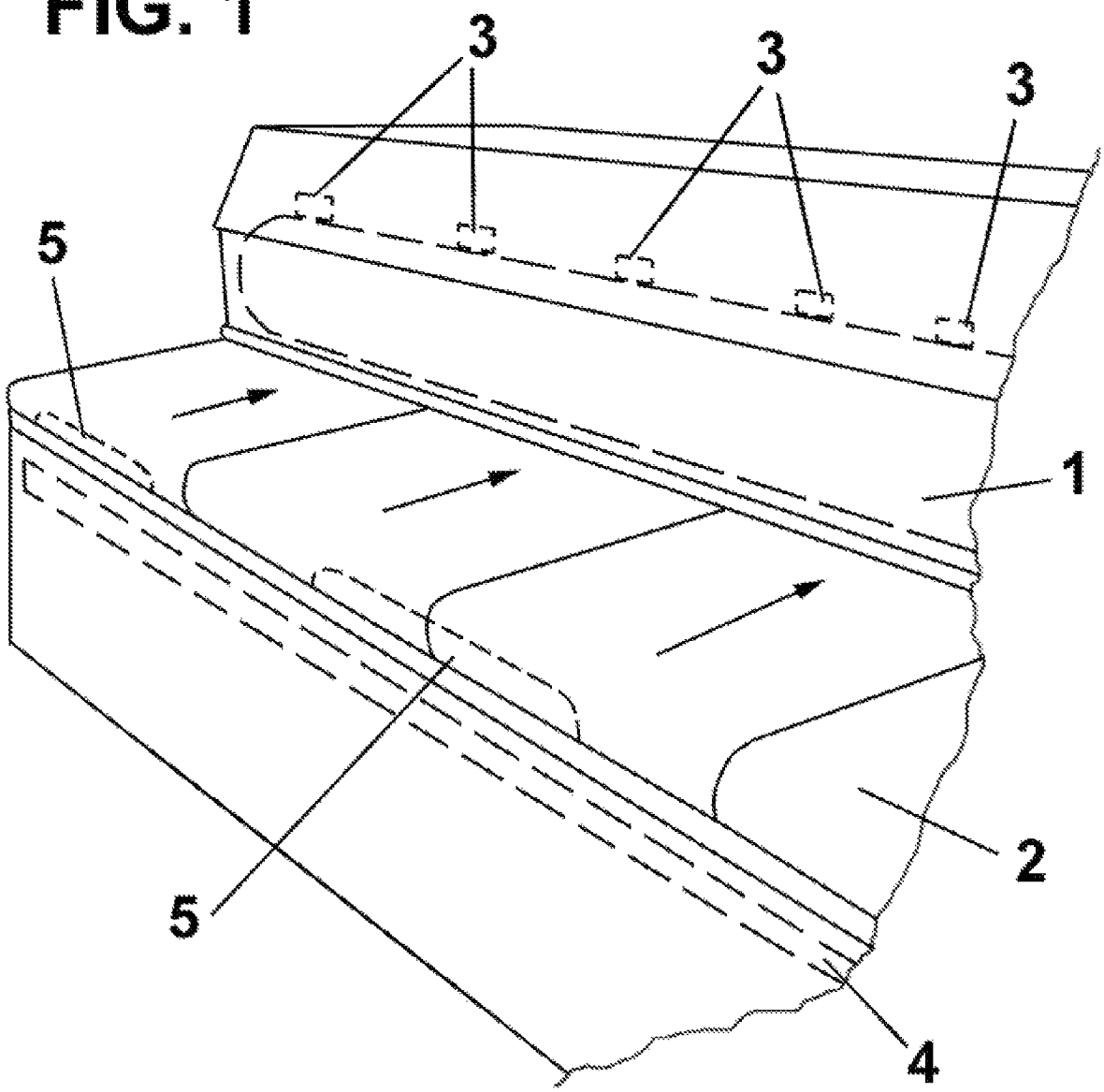
FIG. 1 is a perspective view of a flatwork ironer according to the present invention.

The flatwork ironer according to the present invention comprises a heating cylinder 1 and a plurality of conveying bands 2. Said conveying bands 2 define a plurality of zones where the articles to be ironed are placed in an introduction area. Said articles can be of any suitable kind, such as e.g. bed sheets or tablecloths.

The ironing of the articles is done by the contact of said heating cylinder 1, which is at a high temperature, and the conveying bands 2. As the flatwork ironer according to the present invention is used, the temperature of the surface of the heating cylinder 1 changes by the ironing action. E.g. the articles can be humid, and their contact with the heating cylinder 1 makes the temperature in this zone to decrease.

For obtaining the ideal ironing, the surface of the heating cylinder 1 must be at a suitable temperature. To this end, the articles must be introduced in the ironer changing the zones of the bands in the introduction area, because in other case part of the surface of the heating cylinder 1 would be too heat and other would be too cold.

To avoid this, the flatwork ironer according to the present invention comprises a plurality of sensors 3, which detect the temperature of different zones of the heating element and inform the operator which zones of the bands are suitable for placing the articles to be ironed at each moment.

According to the present invention, the flatwork ironer comprises indicating means placed in said introduction area so that the operator does not looks away from this introduction area.

According to a preferred embodiment, said indicating means is light from light emitters 4. Said light emitters 4 provide lighting zones 5 of the conveying bands 2, as shown in FIG. 1.

Said lighted zones 5 are preferably the zones where the articles to be ironed must be placed, even though according to the configuration of the ironer, it could differently, i.e. the zones where they must not be placed.

Said light emitters 4 can be light emitting diodes (LEDs) or laser light emitters, or any kind of suitable light emitter.

E.g. as shown in FIG. 1, said light emitters 4 can be placed aligned adjacent to the introduction area of said conveying bands 2, lighting said zones 5 directly.

Figure 2:
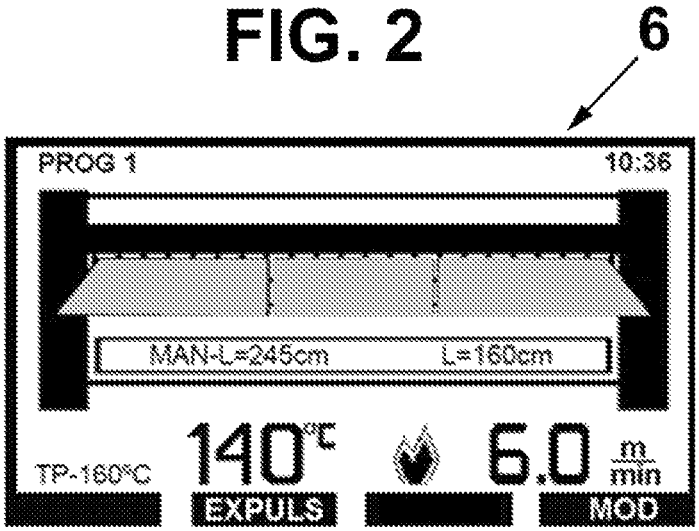
FIG. 2 is a frontal view of the visualization display used in the flatwork ironer according to the present invention.

The flatwork ironer according to the present invention can also comprise a visualization display 6, shown in FIG. 2. This visualization display 6 is conventional, and it provides information about the zones of the conveying bands 2 that must be used and also other information related with the operation of the flatwork ironer.

It must be pointed out that this visualization display 6 can be placed in any suitable position of the ironer, because it is not necessary that the operator looks at it continuously during the use of the ironer, as must be done currently.

As cited previously, with the flatwork ironer according to the present invention the operator also places the articles to be ironed in the correct zone of the conveying bands 2, enhancing the productivity of the ironer, because the operator does not look away from the introduction are, providing an indication of the suitable zone of the conveying band 2, e.g. lighting it directly.

Even though reference has been made to a specific embodiment of the invention, it is apparent for a person skilled in the art that the disclosed flatwork ironer is susceptible of numerous variations and modifications, and that all the cited details can be substituted by other technically equivalent ones, without departing from the scope of protection defined by the attached claims.

The invention claimed is:

1. A flatwork ironer, comprising:

a heating cylinder, a plurality of conveying bands, defining said conveying bands a plurality of zones in an introduction area for introducing articles to be ironed, and a plurality of temperature sensors of said heating cylinder, indication means for indicating at least one zone of the conveying bands where the articles to be ironed must be placed according to the temperature detected by said plurality of sensors, characterized in that said indication means are placed in said introduction area for introducing the articles to be ironed.

2. The flatwork ironer according to claim 1, wherein said indication means is a light emitted from a plurality of light emitters that light at least one zone of the conveying bands.

3. The flatwork ironer according to claim 2, wherein said light emitters are light emitter diodes (LEDs).

4. The flatwork ironer according to claim 2, wherein said light emitters are laser light emitters.

5. The flatwork ironer according to claim 2, wherein said light emitters are placed adjacent to the introduction area of said conveying bands.

6. The flatwork ironer according to claim 1, also comprising a visualization display indicating at least one zone of the conveying bands.

* * * * *